US006256459B1

(12) United States Patent
Hasegawa et al.

(10) Patent No.: US 6,256,459 B1
(45) Date of Patent: Jul. 3, 2001

(54) DEVELOPING APPARATUS AND IMAGE FORMING APPARATUS USING THE SAME DEVELOPING APPARATUS AND METHOD OF DETERMINING END-OF-TONER CONDITION

(75) Inventors: Shin Hasegawa, Chiba; Tomoji Ishikawa, Yokohama; Takeroh Kurenuma, Yokosuka; Makoto Yoshioka, Saitama-ken, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/455,945

(22) Filed: Dec. 7, 1999

(30) Foreign Application Priority Data

Dec. 7, 1998 (JP) ..... 10-347326

(51) Int. Cl.[7] ..... G03G 15/01; G03G 15/08

(52) U.S. Cl. ..... 399/27; 399/223

(58) Field of Search ..... 399/27, 28, 61, 399/64, 223, 226, 227; 356/436; 250/573, 577

(56) References Cited

U.S. PATENT DOCUMENTS 5,557,368 * 9/1996 Endo et al. ..... 399/27
5,671,470 9/1997 Maruta et al. ..... 399/235
5,826,146 10/1998 Maruta et al. ..... 399/235
5,899,597 * 5/1999 Shinohara et al. ..... 399/64
5,970,278 10/1999 Munakata ..... 399/46

FOREIGN PATENT DOCUMENTS 8-137175 * 5/1996 (JP) .
08160698 6/1996 (JP) .
09120209 5/1997 (JP) .
11-327287 * 11/1999 (JP) .

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An end of toner detector to be utilized in a toner cartridge of a developing apparatus of an image forming apparatus. A developing device develops latent images formed on an image bearing member so as to form toner images. A toner storage unit deposits toner to supply to the developing device. A light path forming unit protrudes from a wall of the toner storage unit into an interior of the toner storage unit and forms the light path through which light passes in the toner storage unit. A light sensor includes a light emitting unit which emits light and a light receiving unit which receives light emitted from the light emitting unit. Further, the light sensor outputs signals which smoothly change according to an amount of toner in the light path formed in the light forming unit.

29 Claims, 8 Drawing Sheets

DEVELOPING APPARATUS AND IMAGE FORMING APPARATUS USING THE SAME DEVELOPING APPARATUS AND METHOD OF DETERMINING END-OF-TONER CONDITION

CROSS-REFERENCE TO RELATED APPLICATIONS

This document claims priority and contains subject matter related to Japanese Patent Application No. 10-347326 filed in the Japanese Patent Office on Dec. 7, 1998, the entire contents of which are hereby incorporated herein by reference.

BACKGROUND OF THE INVENTION

1. Field of the Invention

The present invention relates to a developing apparatus for use in an image forming apparatus, such as a photocopier, a facsimile, a printer, etc., and more particularly to a developing apparatus and method of determining an end-of-toner condition in a toner storage unit.

2. Discussion of the Background

As a background image forming apparatus and a background developing apparatus which determine an end-of-toner condition in a toner storage unit, Japanese Laid-open Patent Publication No. 9-120209 describes an end-of-toner detection device that includes (1) a light path forming unit that protrudes from a wall of a toner storage unit to form a light path along which a light beam passes through an inside of the toner storage unit, and (2) a light sensor of a light-transmission type that includes a light-emitting unit that emits light to a first light-reflecting surface of the light path forming unit and a light-receiving unit that receives the light reflected from a second light-reflecting surface of the light path forming unit. In the above-described end-of-toner detection device, when toner remains in the toner storage unit, the light emitted from the light-emitting unit is blocked by the toner in the light path and does not reach the light-receiving unit. As the amount of toner decreases in the toner storage unit, the intensity of light received by the light-receiving unit increases. In the light sensor, a reference value of the intensity of light received by the light-receiving unit is fixed to detect the end-of-toner condition in the toner storage unit. The light sensor compares the intensity of light received by the light-receiving unit with the reference value, and sends binary output signals (Level High/Level Low) to indicate the end-of-toner condition in the toner storage unit.

However, when the reference value for detecting the end-of-toner condition is fixed in the light sensor, an end-of-toner detection error may be caused by factors such as unevenness of sensitivity of the light sensor, color of toner, etc. For example, when the light sensor has higher sensitivity, the light-receiving unit of the light sensor may receive more light and may determine the end-of-toner condition even though toner remains in the toner storage unit. Further, when the light sensor is stained by scattered toner, the intensity of light received by the light-receiving unit may change, so that an end-of-toner determination error may be caused. Furthermore, because each color toner has a different characteristic of light transmission factor, the intensity of light received by the light-receiving unit may change according to the color of toner, so that an end-of-toner determination error may be caused by the end-of-toner detection employing a fixed reference value.

SUMMARY OF THE INVENTION

The present invention has been made in view of the above-discussed and other problems, and an object of the present invention is to address and resolve the above-discussed and other problems.

Accordingly, one object of the present invention is to provide a novel developing apparatus and method, in which an end-of-toner condition in a toner storage unit is precisely determined.

Another object of the present invention is to provide a novel image forming apparatus and method, in which an end-of-toner condition in a toner storage unit is precisely determined.

The present invention achieves the above and other objects by providing a novel design for an end of toner detector to be utilized in a toner cartridge for a developing apparatus of an image forming apparatus.

A specific embodiment of a developing apparatus of the present invention which achieves the above-noted and other objects includes a developing device which develops latent images formed on an image bearing member so as to form toner images. A toner storage unit stores toner to supply to the developing device. A light path forming unit protrudes from a wall of the toner storage unit into an interior of the toner storage unit and forms the light path through which light passes in the toner storage unit. A light sensor includes a light emitting unit which emits light and a light receiving unit which receives light emitted from the light emitting unit. Further, the light sensor outputs signals which smoothly change according to an amount of toner in the light path formed in the light forming unit.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
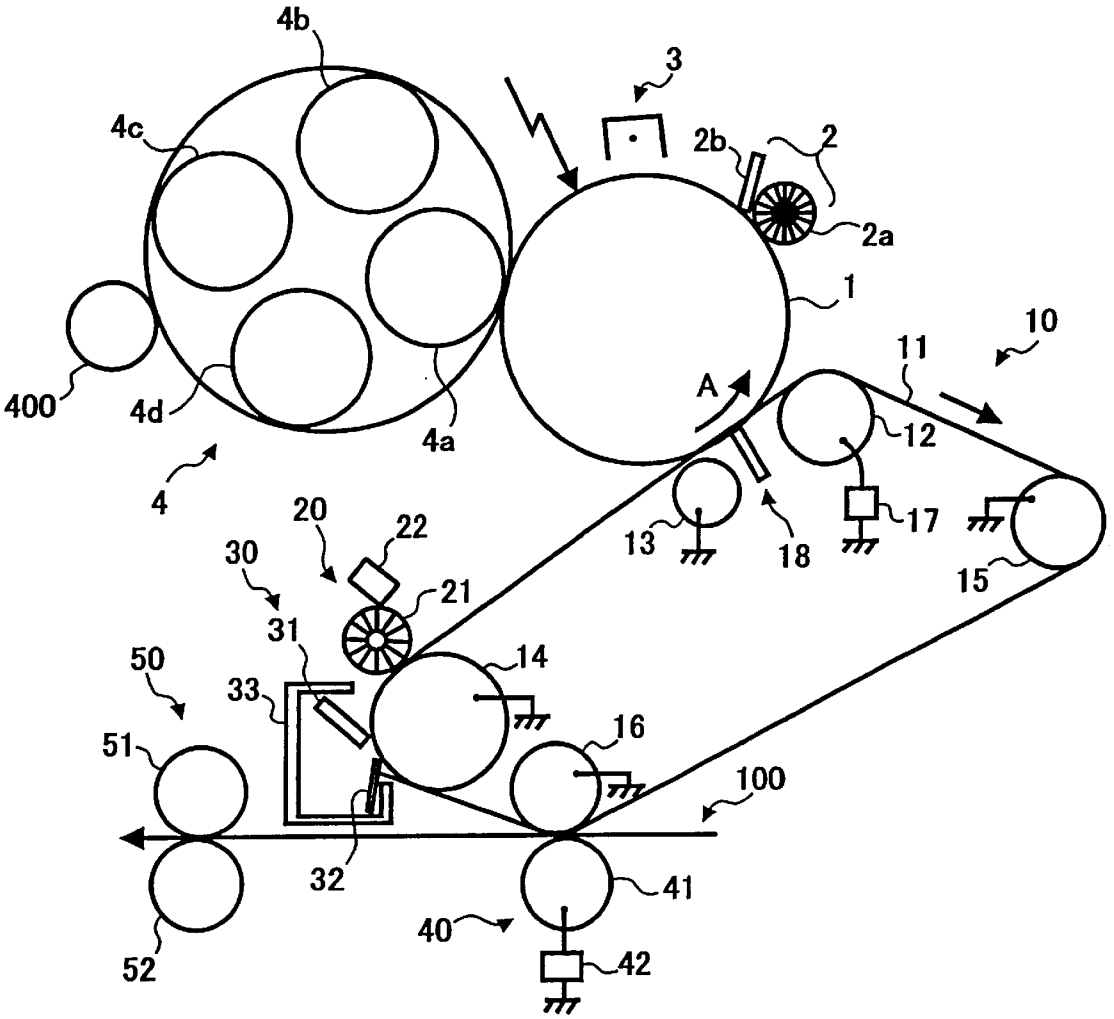
FIG. 1 is a schematic front view illustrating an overall configuration of a multi-color image forming apparatus according to an embodiment of the present invention.

Referring now to the drawings, wherein like reference numerals designate identical or corresponding parts throughout the several views, FIG. 1 is a schematic front view illustrating an overall configuration of a multi-color image forming apparatus according to an embodiment of the present invention. The multi-color image forming apparatus includes a color image reading unit (hereinafter referred to as a scanner unit) and a color image recording unit (hereinafter referred to as a printer unit).

First, a main configuration and operation of the scanner unit (not shown) of the multi-color image forming apparatus is described. In the scanner unit, an image of an original document carried on a platen glass is focused on a color sensor through an illumination/mirror optical system including an illumination lamp, a group of mirrors, and a lens. The color sensor includes a color separating device to separate colors of light into red (R), green (G), and blue (B) components and a photoelectric conversion device, such as a charge coupled device (CCD), to convert each of the separated color components into electric image signals. The color sensor reads three colors simultaneously. Respective image signals of R, G, B produced in the scanner unit are subjected to color conversion processing in an image processing unit based on their respective intensity levels. The color conversion processing results in color image data of black (Bk), cyan (C), magenta (M), and yellow (Y). Specifically, the illumination/mirror optical system of the scanner unit is responsive to a start signal associated with the printer unit to scan an original document to obtain color image data. In this embodiment, image data for one color is obtained each time the illumination/mirror optical system scans an original document, so that the illumination/mirror optical system scans a total of four times in order to obtain color image data for the four colors Bk, C, M, and Y.

Referring to FIG. 1, the configuration and operation of the printer unit of the multi-color image forming apparatus according to an embodiment of the present invention is described. The printer unit includes an optical writing unit (not shown) serving as an exposing device and a photoconductive drum 1 as an image bearing member. The optical writing unit converts color image data from the above-described scanner unit to optical signals to form a latent image corresponding to an original image on the photoconductive drum 1 which is uniformly charged with negative electricity. For example, the optical writing unit may include a semiconductor laser, a light emission driving controller for controlling emission and driving of the semiconductor laser, a polygon mirror, a rotation driving motor for rotating the polygon mirror, an f-theta lens, a reflection mirror, etc. The photoconductive drum 1 is driven to rotate in a counter-clockwise direction (i.e., in the direction indicated by arrow A in FIG. 1).

Arranged around the photoconductive drum 1 are the optical writing unit (not shown), a cleaning unit 2 for cleaning the photoconductive drum 1, a charger 3 as a charging device, a revolver-developing unit or a rotating developing unit 4, and an intermediate transfer unit 10. The cleaning unit 2 includes a fur blush 2*a* and a cleaning blade 2*b* to clean the surface of the photoconductive drum 1 after primary transfer (transfer from the photoconductive drum 1 to an intermediate transfer belt 11 of the intermediate transfer unit 10). A latent image forming device which forms latent images on the photoconductive drum 1 includes the optical writing unit and the charger 3.

The revolver-developing unit 4 includes a black (Bk) developing device 4*a*, a cyan (C) developing device 4*b*, a magenta (M) developing device 4*c*, and a yellow (Y) developing device 4*d*. Each of the developing devices 4*a*, 4*b*, 4*c*, and 4*d* is located at a position opposed to the photoconductive drum 1 as a result of rotating the revolver-developing unit 4. Each of the developing devices 4*a*, 4*b*, 4*c*, and 4*d* includes a developing paddle (not shown) as an agitating device to pump up and agitate a developer-mix, a toner density detection sensor (not shown) as a toner density detection device to detect the toner density of the developer-mix, and a developing sleeve (not shown) as a developer carrier for making the developer-mix in an ear shape to contact the surface of the photoconductive drum 1. Each configuration of the side of the developing devices 4*a*, 4*b*, 4*c*, and 4*d* is substantially the same. The revolver-developing unit 4 is driven by a stepping motor 400 serving as a developing unit driving device.

Each of the developing devices 4*a*, 4*b*, 4*c*, and 4*d* uses a two-component developer-mix as a developer, which is, for example, a mixture of carrier powder and toner powder. The toner in the developer-mix is negatively charged. The toner density detection sensor detects the condition when the toner is consumed for development and the toner density of the developer-mix in each of the developing devices 4*a*, 4*b*, 4*c*, and 4*d* is decreased. In this case, each toner is supplied from a toner cartridge (not shown) of a toner supply unit (not shown) to the developing devices 4*a*, 4*b*, 4*c*, and 4*d* so as to keep the toner density of the developer-mix in the developing devices 4*a*, 4*b*, 4*c*, and 4*d* at a predetermined value. In addition, when the amount of toner is reduced for consumption in the toner cartridge, an end-of-toner detection device including a light sensor (details of which are described later) detects whether toner remains in the toner cartridge.

The intermediate transfer unit 10 includes the intermediate transfer belt 11, a primary transfer bias roller 12 as a charge applying device, a primary transfer power supply 17 connected to the primary transfer bias roller 12, a ground roller 13 as a discharging device before the primary transfer, a belt driving roller 14, a belt tension roller 15, and a secondary transfer unit opposing roller 16. The intermediate transfer belt 11 is spanned around the primary transfer bias roller 12, the ground roller 13, the belt driving roller 14, the belt tension roller 15, and the secondary transfer unit opposing roller 16. The primary transfer bias roller 12 is connected to a primary transfer power supply 17. The belt drive roller 14 is connected to a drive motor (not shown) that is controlled by a controller (not shown). Each roller around which the intermediate transfer belt 11 spans, except the primary transfer bias roller 12, is electrically conductive and grounded to the chassis of the multi-color image forming apparatus.

The primary transfer bias roller 12 is positioned downstream of a primary transfer area defined by a nip formed between the photoconductive drum 1 and the intermediate transfer belt 11 in a direction in which the surface of the intermediate transfer belt 11 moves. The primary transfer bias roller 12 is applied with a primary transfer bias by the primary transfer power supply 17. The ground roller 13 is disposed upstream of the primary transfer area in the moving direction of the intermediate transfer belt 11. The intermediate transfer belt 11 is pressed against the photoconductive drum 1 by the primary transfer bias roller 12 and the ground roller 13, whereby the nip is formed.

The intermediate transfer belt 11 may be formed in a multiple layer structure including a surface layer, an intermediate layer, and a base layer. The surface layer is positioned on the outer peripheral side of the intermediate transfer belt 11 which contacts the photoconductive drum 1, and the base layer is positioned on the inner peripheral side. An adhesive layer is interposed between the intermediate layer and the base layer to adhere those two layers. The intermediate transfer belt 11 may be formed to have volume resistivity ρv, as measured by the method described in JIS (Japanese Industrial Standards) K 6911, of $10^{11}$ Ωcm. If the intermediate transfer belt 11 has volume resistivity ρv of $10^{12}$ Ωcm or more, it is effective to avoid toner scattering around the image after primary transfer, but it is necessary to discharge the intermediate transfer belt 11 after secondary transfer (a transfer from the intermediate transfer belt 11 to a transfer sheet 100). An intermediate transfer belt 11 which has volume resistivity ρv of $10^{14}$ Ωcm or more might also be used, but may not be suitable for the intermediate transfer belt 11 from a viewpoint of durability. In addition, the surface resistivity at the surface layer of the intermediate transfer belt 11 may be set to about $10^{13}$ Ω.

Further, a reinforcing member may be provided at both ends in the width direction of the back surface of the intermediate transfer belt 11 to avoid twists in the intermediate transfer belt 11. However, a gap may be formed between the both ends in the width direction of the intermediate transfer belt 11 and the photoconductive drum 1 at the time of primary transfer due to the reinforcing member. In order to fill the gap, a backup member 18 is provided on the back surface of the intermediate transfer belt 11 such that the backup member 18 abuts against the both ends in the width direction of the intermediate transfer belt 11.

Arranged around the intermediate transfer belt 11 are a lubricant applying device 20, a belt cleaning device 30, and a secondary transfer unit 40 as a secondary transfer device. The lubricant applying device 20, the belt cleaning device 30, and the secondary transfer unit 40 are configured to contact or separate from the intermediate transfer belt 11 by contact/separate mechanisms (not shown).

The lubricant applying device 20 includes a lubricant applicator brush roller 21 as a lubricant applying member and a lubricant container case 22. The lubricant container case 22 contains a solid lubricant (not shown) and a spring (not shown). As the solid lubricant, for example, a zinc stearate bar made of microparticles can be used. The solid lubricant is biased toward the lubricant applicator brush roller 21 by the spring, and abuts the lubricant applicator brush roller 21. Further, the lubricant applicator brush roller 21 is configured to rotate by a driving device (not shown). When the lubricant is applied to the intermediate transfer belt 11 after secondary transfer, the lubricant applicator brush roller 21 rotates and abrades the solid lubricant. Then, the abraded zinc stearate microparticles are applied onto the intermediate transfer belt 11. The lubricant applicator brush roller 21 is controlled to rotate such that the linear velocity of the lubricant applicator brush roller 21 is faster than the linear velocity of the intermediate transfer belt 11 at the position where the lubricant applicator brush roller 21 and the intermediate transfer belt 11 contact each other (i.e., at the lubricant application area).

The belt cleaning device 30 includes a belt cleaning blade 31 as a cleaning member, an entrance seal member 32 as a seal device, and a case 33. The case 33 contains the toner scraped off by the belt cleaning blade 31. The entrance seal member 32 receives and guides the toner scraped off by the belt cleaning blade 31 into the case 33 to prevent the toner from being scattered in the main body of the multi-color image forming apparatus.

The secondary transfer unit 40 includes a secondary transfer bias roller 41 which opposes the secondary transfer unit opposing roller 16 of the intermediate transfer unit 10, and a secondary transfer power supply 42 which connects to the secondary transfer bias roller 41.

The printer unit further includes a sheet feeding roller (not shown) which feeds the transfer sheet 100 as a transfer material to a secondary transfer area formed between the secondary transfer bias roller 41 and the secondary transfer unit opposing roller 16, a registration roller (not shown), transfer sheet cassettes (not shown) which stock transfer sheets 100 of various sizes, a manual sheet feeding tray (not shown) for a transparent film and a thick transfer sheet, a sheet transfer unit (not shown), a fixing unit 50 as a fixing device, and a copy tray (not shown). The unfixed toner image on the transfer sheet 100 is melted between a pair of fixing rollers 51, 52 including a fixing roller 51 controlled at a predetermined temperature and a pressure roller 52, and the unfixed toner image is fixed on the transfer sheet 100.

Next, an image forming operation of the multi-color image forming apparatus in which the development is performed in the order of black (BK), cyan (C), magenta (M), and yellow (Y) is explained. The image forming is not limited to this particular order.

When a copying operation starts, a black image forming operation starts first. The color image information of an original document is read in the scanner unit. A black latent image is formed on the photoconductive drum 1 by a laser beam generated from the optical writing unit based on the black image data obtained from the image information in the printer unit. The black latent image is developed with black toner by the black developing device 4*a*. In order to develop the black latent image adequately, the developing sleeve of the black developing device 4*a* is rotated before the leading edge of the black latent image reaches a developing position of the black developing device 4*a*. Thereby, the whole black latent image can be adequately developed with black toner because a developer ear is already formed when the leading edge of the black latent image reaches the developing position of the black developing device 4*a*. Also, in the black developing device 4*a*, when the trailing edge of the black latent image passes the developing position, the developer ear formed on the developing sleeve of the black developing device 4*a* is immediately discontinued. Thereby, the black developing device 4*a* returns to a standby condition. At this time, the black developing device 4*a* is configured to return to a standby condition before the leading edge of a cyan latent image, to be next developed, reaches the developing position of the black developing device 4*a*. The developer ear may be discontinued by switching the developing sleeve to the direction reverse to the rotating direction during the developing operation.

After developing operation, the black toner image formed on the photoconductive drum 1 is transferred to the surface of the intermediate transfer belt 11 which is driven at substantially the same speed as the photoconductive drum 1 (i.e., primary transfer is affected). Thereby, the black image forming operation is completed.

In parallel with the above-described primary transfer of the black toner image, the next cyan image forming operation starts on the photoconductive drum 1. Specifically, the color image information of the original document is again read in the scanner unit at a predetermined timing. A cyan latent image is formed on the photoconductive drum 1 by a laser beam generated from the optical writing unit based on the cyan image data obtained from the image information in the printer unit. The cyan latent image is developed with cyan toner by the cyan developing device 4*b*. The rotation of the developing sleeve of the cyan developing device 4*b* is started after the trailing edge of the black latent image passes a developing position of the cyan developing device 4*b* and before the leading edge of the cyan latent image reaches the developing position. Similarly as in the black toner development, a developer ear formed on the developing sleeve of the cyan developing device 4*b* is discontinued, when the trailing edge of the cyan latent image passes the developing position. Thereby, the cyan developing device 4*b* returns to a standby condition. At this time, the cyan developing device 4*b* is configured to return to a standby condition before the leading edge of a magenta latent image, to be next developed, reaches the developing position of the cyan developing device 4*b*.

After the cyan developing operation, the cyan toner image formed on the photoconductive drum 1 is transferred to the surface of the intermediate transfer belt 11 in precise register with the black toner image.

Following the black and cyan image forming process, a similar image forming process including the formation of the latent image, the development, and the primary transfer for magenta and yellow is subsequently performed based on each image data. By transferring the respective black, cyan, magenta, and yellow toner images sequentially formed on the photoconductive drum 1 to the same image surface area on the intermediate transfer belt 11, a complete toner image is formed on the intermediate transfer belt 11 with four color images superimposed on each other.

During a time period in which a complete toner image is formed on the intermediate transfer belt 11, specifically during a time period from the time the first color (black) toner image has been transferred to the intermediate transfer belt 11 to the time the fourth color (yellow) toner image has been transferred to the same, the lubricant applicator brush roller 21, the belt cleaning blade 31, the entrance seal member 32, and the secondary transfer bias roller 41 are separated from the intermediate transfer belt 11 by respective contact/separation mechanisms (not shown).

The toner image transferred to the intermediate transfer belt 11 in the manner described above is conveyed to the secondary transfer area for secondary transfer to the transfer sheet 100. In this event, the secondary transfer bias roller 41 of the secondary transfer unit 40 is generally pressed against the intermediate transfer belt 11 by a transfer contact/separation mechanism (not shown) at the time the toner image is to be transferred to the transfer sheet 100. Subsequently, the secondary transfer bias roller 41 is applied with a predetermined secondary transfer bias by a secondary transfer power supply 42 to form a secondary transfer electric field in the secondary transfer area. The secondary transfer electric field causes the toner image on the intermediate transfer belt 11 to be transferred to the transfer sheet 100. The transfer sheet 100 is conveyed from transfer sheet cassettes of a size specified by an operator on an operation panel (not shown) in a direction toward the registration roller, and fed into the secondary transfer area. More specifically, the transfer sheet 100 is fed into the secondary transfer area at the time coincident with the arrival of the leading edge of the toner image on the intermediate transfer belt 11 to the secondary transfer area.

After the primary transfer, the surface of the photoconductive drum 1 is cleaned by the cleaning unit 2, and is then uniformly discharged by a discharging lamp (not shown). Also, after the secondary transfer, the surface of the intermediate transfer belt 11 is cleaned by the belt cleaning device 30 which is pressed against the intermediate transfer belt 11 by a belt cleaning contact/separation mechanism (not shown).

Next, the determination of an end-of-toner condition according to an embodiment of the present invention is explained.

Figure 2:
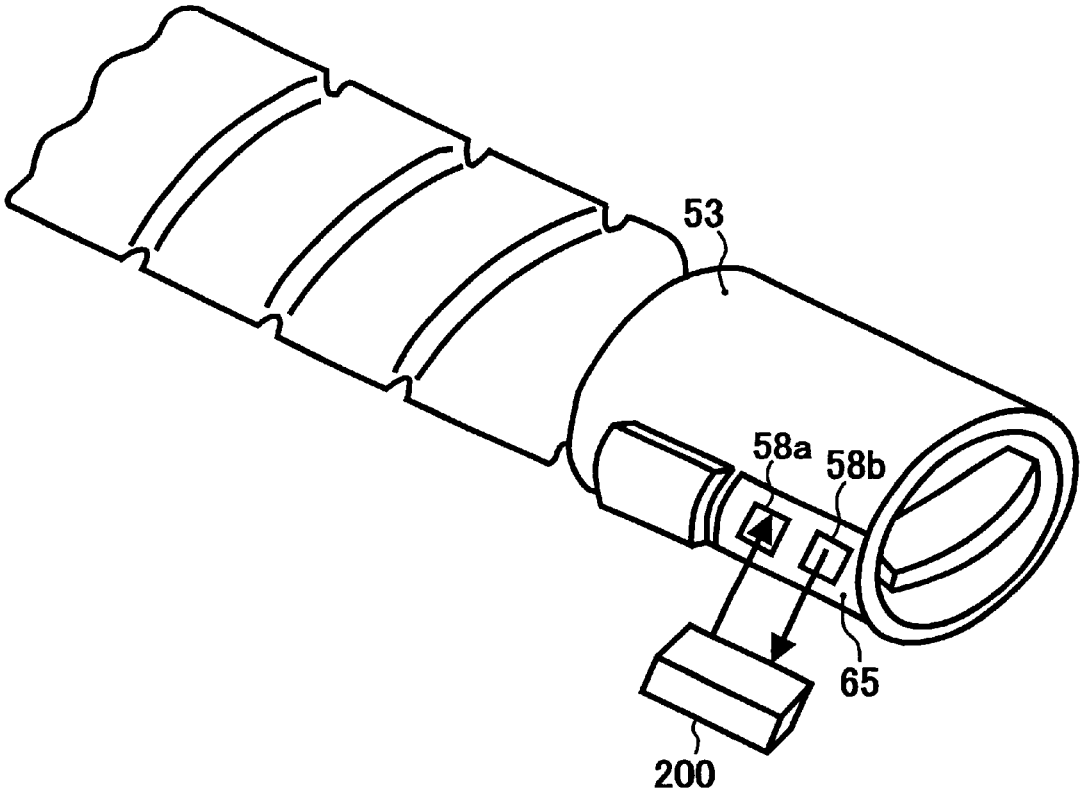
FIG. 2 is a perspective view of a toner cartridge used in the multi-color image forming apparatus of FIG. 1.
Figure 3:
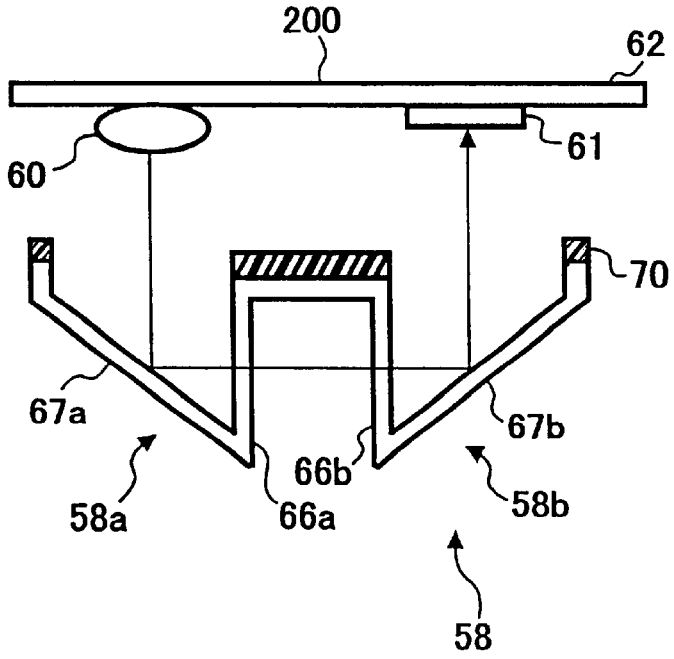
FIG. 3 is a schematic view illustrating an overall configuration of a light sensor and a reflector according to an embodiment of the present invention.
Figure 4:
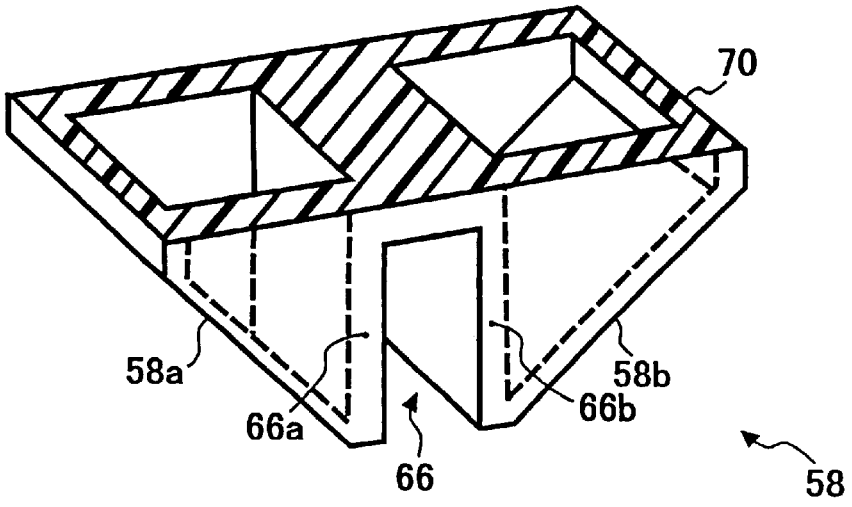
FIG. 4 is a perspective view of the reflector of FIG. 3.

FIG. 2 is a perspective view of a toner cartridge. FIG. 3 is a schematic view illustrating an overall configuration of a light sensor and a reflector. FIG. 4 illustrates a perspective view of the reflector.

Referring to FIGS. 2 through 4, a light sensor 200 includes a light-emitting unit (e.g., an infrared light-emitting device) 60 and a light-receiving unit (remote controller photoreceptor device) 61 that are mounted on a substrate 62. A reflector 58 serving as a light path forming unit includes a hollow recess 58*a* opposite the light-emitting unit 60 and a hollow recess 58*b* opposite the light-receiving unit 61 that protrude from an exterior part 65, which is a part of a wall of a toner cartridge 53 and which faces the light-emitting unit 60 and the light-receiving unit 61, into the interior of the toner cartridge 53. The reflector 58 further includes transparent parts 66*a* and 66*b*, which are transparent to the light emitted from the light-emitting unit 60, in the facing walls of the pair of hollow recesses 58*a* and 58*b*. Between the facing walls of the pair of recesses 58*a* and 58*b*, a concave part 66 is formed. The concave part 66 is located inside of the toner cartridge 53, in which toner is deposited. On the recess opposite the light-emitting unit 58*a*, a reflecting surface 67*a* is formed to reflect the light beam coming from the light-emitting unit 60 toward the transparent part 66*a* that is located on the wall of the recess opposite the light-emitting unit 58*a*. Also, on the recess opposite the light-receiving unit 58*b*, a reflecting surface 67*b* is formed to reflect the light beam that has passed through the transparent parts 66*b* located in the wall of the recess opposite the light-receiving unit 58*b*.

In this embodiment, the recess opposite the light-emitting unit 60 and the recess opposite the light-receiving unit 61 may be made of a transparent material such as polystyrene. However, it suffices to use a transparent material at least in the walls of the pair of mutually opposing recesses 58*a* and 58*b*, i.e., at least in the transparent parts 66*a* and 66*b*.

In this embodiment, the end-of-toner condition is detected as follows. Referring to FIGS. 2 and 3, the light beam emitted from the light-emitting unit 60 is reflected by the reflecting surface 67*a* of the recess opposite the light-emitting unit 58*a*, and then passes through the transparent part 66*a*. When toner remains in the light path in the concave part 66 inside the toner cartridge 53, the light that has passed through the transparent part 66*a* is blocked or reduced by the toner according to the amount of remaining toner. On the other hand, when toner does not remain in the light path in the concave part 66 inside the toner cartridge 53, the light that has passed through the transparent part 66*a* is not blocked or reduced by the toner, and therefore the light passes through the transparent part 66*b* of the recess opposite the light-receiving unit 58*b*. Then, the light is reflected by the reflecting surface 67*b* and is received by the light-receiving unit 61. Thus, the light beam emitted from the light-emitting unit 60 is decreased according to the amount of toner in the light path in the concave part 66 of the reflector 58, and is received by the light-receiving unit 61. Then, the light sensor 200 sends output signals according to the amount of light received by the light-receiving unit 61, and thereby the end-of-toner condition is detected based on the output signals from the light sensor 200.

In this embodiment, the recess 58*a* opposite the light-emitting unit 60 is configured such that the light reflected on the reflecting surface 67*a* enters the transparent part 66*a* from a vertical angle. Likewise, the recess 58*b* opposite the light-receiving unit 61 is configured such that the light that has passed through the transparent part 66*a* of the recess opposite the light-emitting unit 58*a* enters the transparent part 66*b* of the recess opposite the light-receiving unit 58*b* from a vertical angle. In the reflector 58 illustrated in FIG. 3, the incident angle at which the light emitted from the light-emitting unit 60 falls incident upon the reflecting surface 67*a* of the recess opposite the light-emitting unit 60, and the angle of reflection of light at which the light is reflected on the reflecting surface 67*b* of the recess opposite the light-receiving unit 58*b* to the light-receiving unit 61, are both set at 45 degrees. This ensures that the transmittance of the light emitted from the light-emitting unit 60 when it passes through the transparent parts 66*a* and 66*b* is greater than the transmittance that would result if the light enters the transparent parts 66*a* and 66*b* from an angle other than a vertical angle. Owing to the above-described configuration of the reflector 58, the light beam is efficiently guided to the light-receiving unit 61 with little diminution in the quantity of light. As a result, an end-of-toner condition can be detected accurately.

Although not illustrated in FIG. 3, the reflecting surfaces 67*a* and 67*b*, which contact the toner, are made with components that have a higher light reflectivity than other components. For example, pieces of silver colored reflecting tape may be affixed onto these surfaces. Thereby, light is reflected with a higher reflectivity when compared with cases in which no reflecting tape is attached, and thus the quantity of light received by the light-receiving unit 61 is increased.

Figure 11:
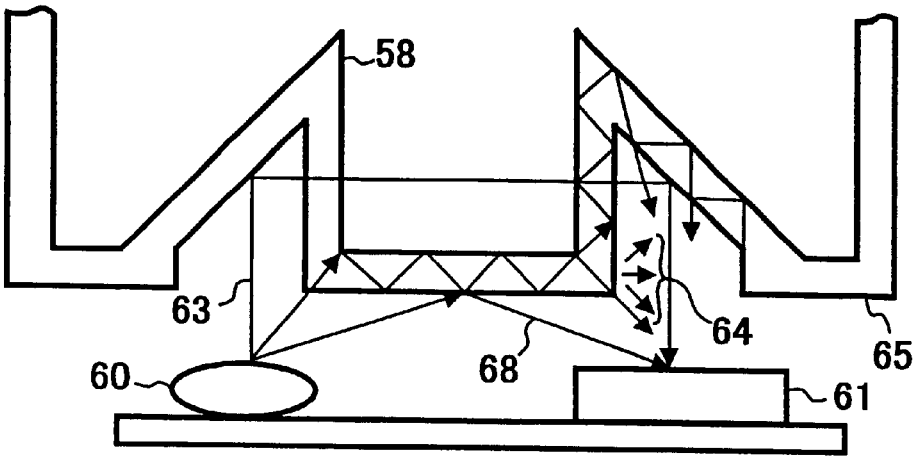
FIG. 11 is an explanatory view illustrating light transmission paths when a light source with a wide directional angle is employed as a light source for a light-emitting unit according to the present invention.

As illustrated in FIG. 11, if a light source with a wide directional angle is employed as the light source for the light-emitting unit 60, in addition to light 63 that is supposed to be received by the light-receiving unit 61, propagation light 64 is likely to be generated that falls incident upon the exterior part 65 of the reflector 58 opposite the light-emitting unit 60 and the light-receiving unit 61. Because the propagation light 64 passes through the exterior part 65 and ultimately is received by the light-receiving unit 61, the propagation light 64 results in a noise in the detection output. As a result, a detection error may be caused such that the light sensor erroneously senses that there is no toner remaining even if toner still remains.

To address the above-described detection error, a light-shielding member 70 made of lightproof material may be attached by, e.g., an adhesive double coated tape (not shown) on the exterior part 65 of the reflector 58, as the diagonally shaded areas in FIGS. 3 and 4 illustrate. As the light-shielding member 70, a lightproof sheet, such as one sold under the trademark Lumirror X30 made by TORAY Company, Ltd. (material: polyethylene terephthalate) may be employed. The light-shielding member 70 eliminates the above-described propagation light 64 among the light beams that are extraneous to the detection of the end-of-toner condition so that the propagation light 64 is not received by the light-receiving unit 61. Thereby, the occurrence of an erroneous end-of-toner detection is prevented in which light extraneous to the detection of the end-of-toner condition is received by the light-receiving unit 61.

Because the light-shielding member 70 also exhibits a light absorption property, reflected light 68 is not produced on the exterior part 65, contrary to the condition illustrated in FIG. 11, and thus it is also possible in this embodiment to prevent the occurrence of an erroneous end-of-toner detection in which the reflected light 68 is received by the light-receiving unit 61.

Figure 5A:
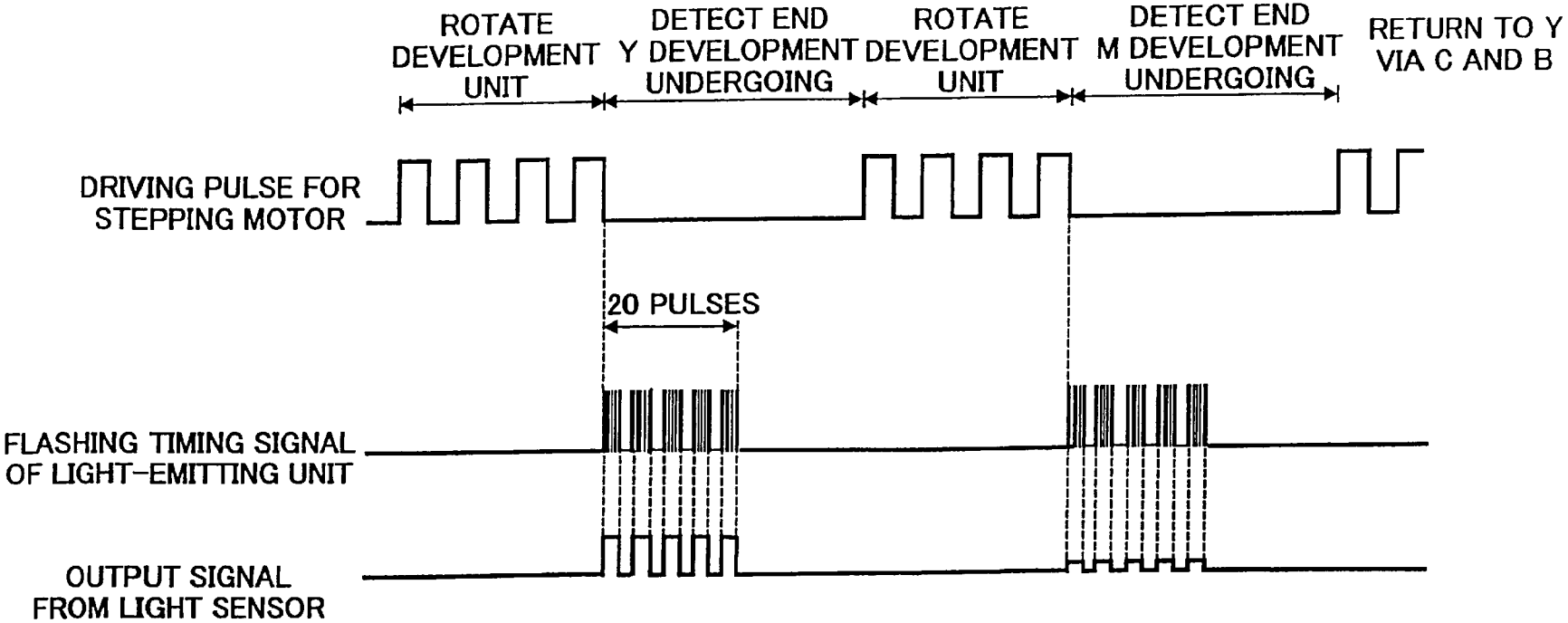
FIG. 5A is a timing chart illustrating rotation timing of a developing unit, development timing, flashing timing of a light-emitting unit, and output timing of output signals from a light-receiving unit.
Figure 5B:
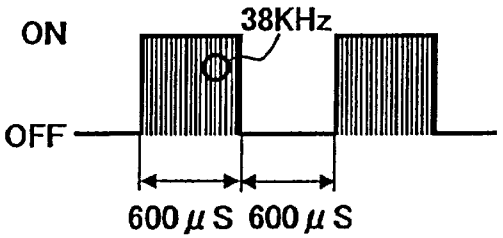
FIG. 5B is an enlarged view of flashing timing signals from the light-emitting unit.

FIG. 5 is a timing chart that illustrates the rotation timing of the revolver-developing unit 4, the development timing, the flashing timing of the light-emitting unit 60, and the output timing of output signals from the light sensor 200 among the timing signals that are used for detecting the end-of-toner condition in this embodiment. The revolver-developing unit 4 is rotated by drive pulses that are transmitted to the stepping motor 400. When the rotation of the revolver-developing unit 4 stops, the development process starts and a determination is made as to whether an end-of-toner condition has arisen. The light beam from the light-emitting unit 60 turns the pulse light emission at, e.g., the fundamental frequency of 38 kHz repeatedly at intervals of 600 microseconds ($\mu$s), thus producing a so-called burst emission. The on/off operation may be repeated 20 times per end-of-toner detection operation. In the example illustrated in FIG. 5, the light sensor 200 is configured to send output signals such that the intensity of the output signals changes according to the amount of toner deposited in the concave part 66 of the reflector 58 inside of the toner cartridge 53. In the main body of the multi-color image forming apparatus, the output signal from the light sensor 200 is compared with a reference value set for end-of-toner determination. The end-of-toner condition in the toner cartridge 53 is determined based on the results of the above-described comparison.

Figure 6:
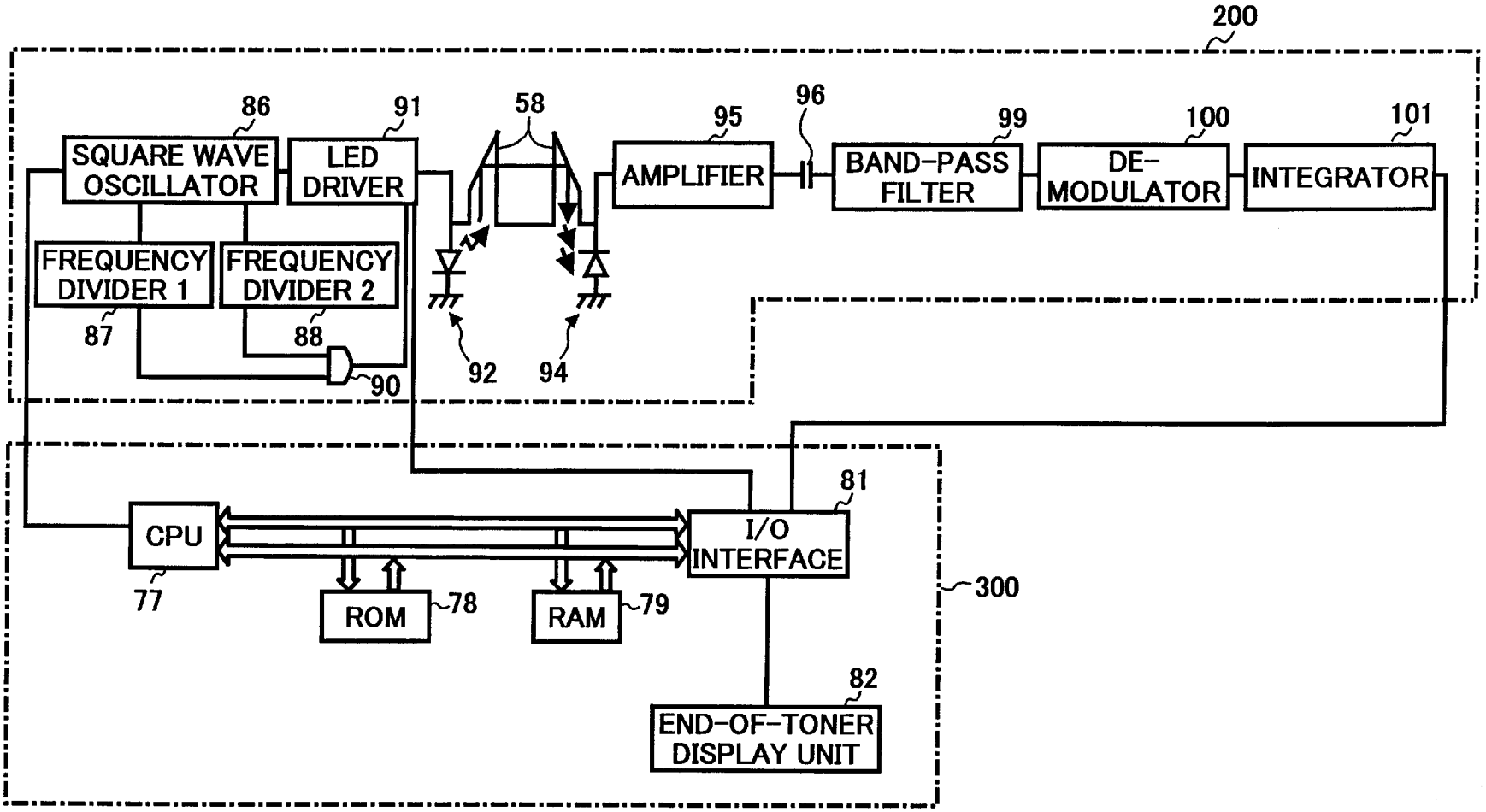
FIG. 6 is a block diagram illustrating an example of a signal processing device of a light sensor and an end-of-toner determination device that determines an end-of-toner condition according to output signals from the light sensor according to the present invention.

FIG. 6 is a block diagram illustrating an example of a signal processing device which is formed on the substrate 62 of the light sensor 200, and an end-of-toner determination device that determines an end-of-toner condition according to the output signal from the light sensor 200. As the end-of-toner determination device, a controller 300 that is provided in the main body of the multi-color image forming apparatus is also used. A central processing unit (CPU) 77, a read-only memory (ROM) 78, a random-access memory (RAM) 79, and an input/output (I/O) interface 81 of the controller 300 are connected by an address bus and a data bus that are indicated by white arrows in FIG. 6. Clock signals with a specified cycle are supplied from a square-wave oscillator 86 to the CPU 77. The signals generated by the square-wave oscillator 86 of the light sensor 200 are also used as timing signals that turn the light-emitting unit 60 on and off. The signals generated by the square-wave oscillator 86 are used by a frequency divider 1(87) to generate pulse signals at 38 kHz, and are also used by a frequency divider 2(88) to generate pulse signals of a 1.2 millisecond cycle. These signals are added by an AND gate 90 and the resulting signals are supplied to an LED (light-emitting device) driver 91. Then, the control signal output from the I/O interface 81 turns an LED (light-emitting device) 92 of the light-emitting unit 60 on and off 20 times on a burst basis.

When the inside of the toner cartridge 53 has reached the end-of-toner condition, the light beam from the LED 92 enters the transparent part 66*b* of the recess opposite the light-receiving unit 58*b* from the transparent part 66*a* of the recess opposite the light-emitting unit 58*a*. Therefore, the light beam is reflected on the reflecting surface 67*b* of the recess opposite the light-receiving unit 58*b* and reaches a photodiode 94 of the light-receiving unit 61. These signals are then amplified by an amp unit 95. Subsequently, a capacitor 96 transmits only the signal components. Furthermore, a bandpass filter 99 transmits only the pulse signals of 38 kHz, and then the signals are demodulated by a demodulator 100, and are integrated by an integrator 101. After that, the signals are sent to the I/O interface 81 of the controller 300 as output signals (analog signals) of the light sensor 200. The I/O interface 81 converts the output signals from the light sensor 200 to digital signals and sends the digital signals to the CPU 77. The CPU 77 compares the digital signals with a predetermined reference value for end-of-toner determination, and determines whether an end-of-toner condition occurs in the toner cartridge 53. When the CPU 77 determines the end-of-toner condition, the CPU 77 causes an end-of-toner display unit 82 to display the end-of-toner condition, and prompts a user to replace the toner cartridge of the color that has the end-of-toner condition.

Figure 7:
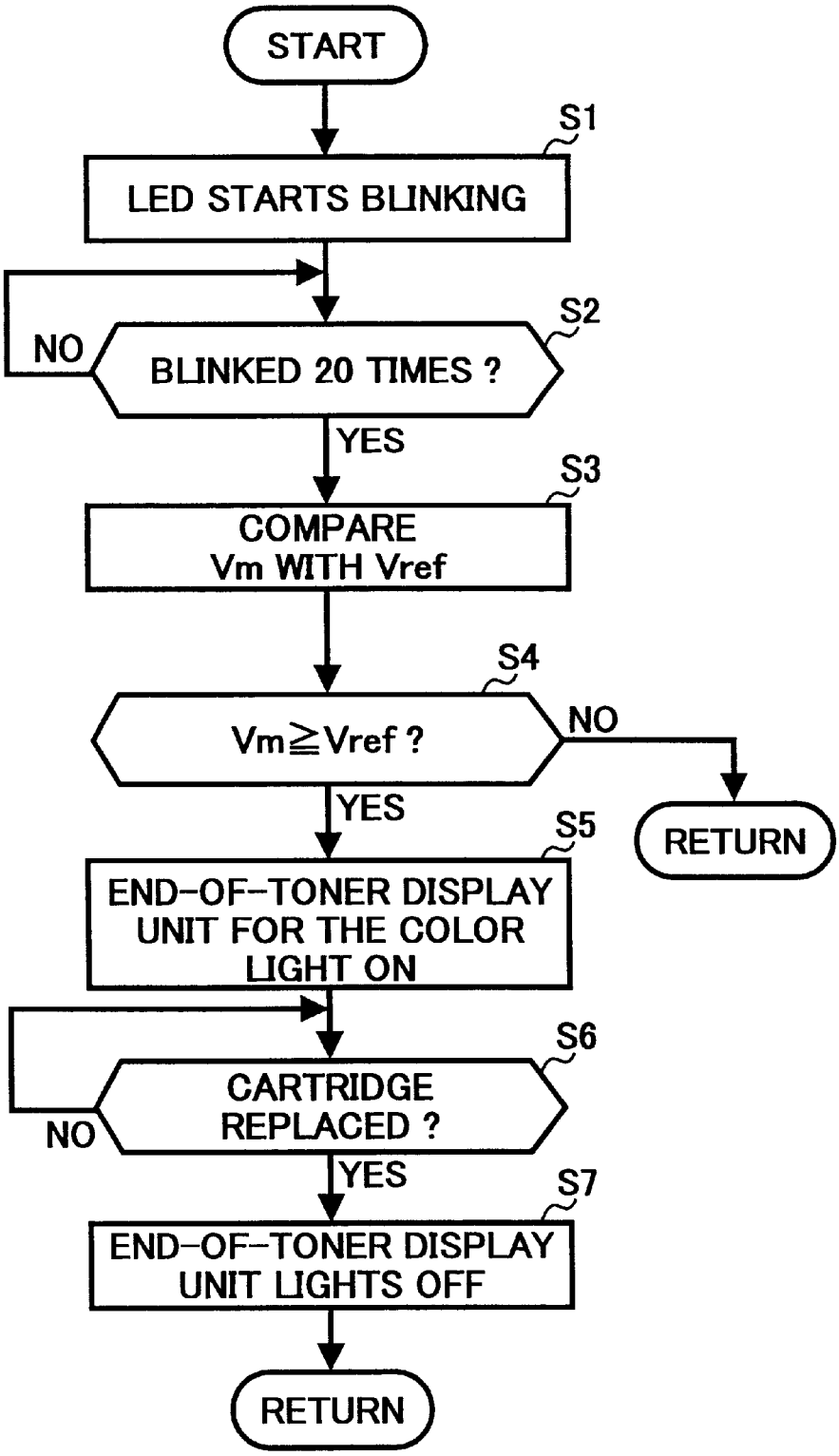
FIG. 7 is a flowchart that illustrates a process by which a CPU determines occurrence of an end-of-toner condition after starting the process for detecting the end-of-toner condition according to the present invention.

FIG. 7 is a flowchart that illustrates the process by which the CPU 77 determines whether the inside of the toner cartridge 53 reaches an end-of-toner condition after the CPU 77 starts the process for detecting an end-of-toner condition. When the revolver-developing unit 4 stops at the development position and starts the development process, the CPU 77 causes the LED 92 of the light-emitting unit 60 to turn on and off in step S1, and determines whether the LED 92 performs 20 burst on and off operations for a specific number, e.g. 20, of times in step S2. If the answer is NO in step S2, the CPU 77 continues to determine whether the burst operation is executed in step S2 until the LED 92 performs burst on and off operations 20 times. If the answer is YES in step S2, the CPU 77 compares a measured value Vm that is converted from the output signals from the light sensor 200 with a reference value Vref set for end-of-toner determination in step S3. Then, in step S4 the CPU 77 determines whether the end-of-toner condition occurs in the toner cartridge 53 based on the results of the above-described comparison. If the measured value Vm is greater than or equal to the reference value Vref in step S4, i.e. YES in step S4, the CPU 77 causes the end-of-toner display unit 82 for that color to display that the end-of-toner condition for that color occurs in step S5. If the measured value Vm is less than the reference value Vref in step S4, i.e. NO in step S4, the CPU 77 returns to the main routine.

In step S6, the CPU 77 determines whether the toner cartridge 53 is replaced based on the display of the end-of-toner condition of the end-of-toner display unit 82. If the answer is NO in step S6, the CPU 77 causes the end-of-toner display unit 82 to continue to display the end-of-toner condition until the toner cartridge 53 is replaced. If the answer is YES in step S6, the CPU 77 turns off the end-of-toner condition display of the end-of-toner display unit 82 in step S7. Then, the CPU 77 returns to the main routine.

Figure 8:
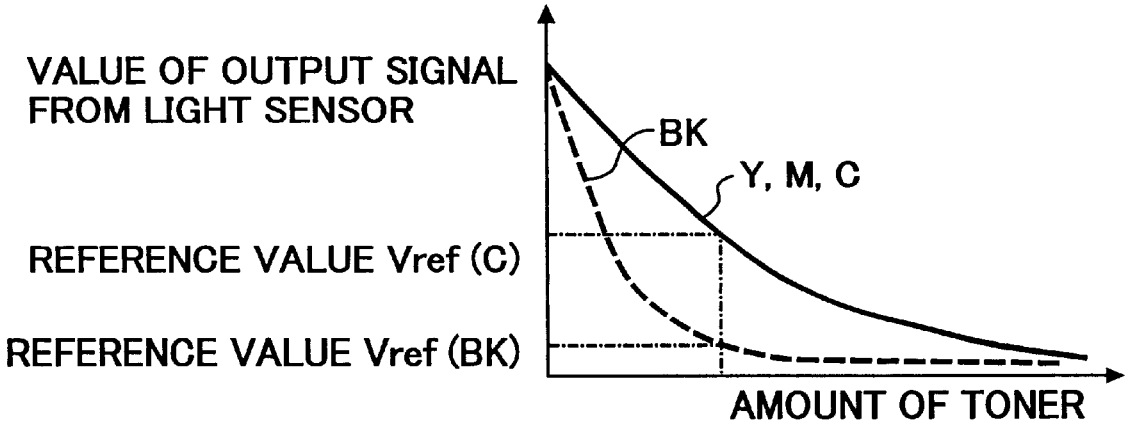
FIG. 8 is a graph illustrating a relation between an amount of toner in a light path in a concave part of a reflector and a value of output signals from the light sensor according to the present invention.

FIG. 8 is a graph illustrating a relation between an amount of toner in the light path in the concave part 66 of the reflector 58 inside the toner cartridge 53 and a value of output signals from the light sensor 200. As illustrated in FIG. 8, as the amount of toner in the light path in the concave part 66 increases, the amount of light received by the light-receiving unit 61 decreases because the light emitted from the light-emitting unit 60 is blocked by the toner, so that the value of output signals from the light sensor 200 decreases. The light sensor 200 outputs signals smoothly changing according to an amount of toner in the light path. Because the amount of light that passes through the concave part 66 differs among the toners of yellow, magenta, cyan, and black, the value of output signals from the light sensor 200 differs according to the color of toner, even though each amount of toner in the light path in the concave part 66 is equal. Therefore, in order to detect precisely the end-of-toner condition for each toner, an adequate reference value for end-of-toner determination is separately set according to the color of toner, in this embodiment. Specifically, a reference value Vref (color) for end-of-toner determination of color toner such as yellow, magenta, and cyan, and a reference value Vref (black) for end-of-toner determination of black toner are set in this embodiment. Each end-of-toner condition is determined when a measured value Vm of the output signals of the light sensor 200 is greater than or equal to each reference value Vref. Thereby, the end-of-toner condition can be accurately determined for both color toners (yellow, magenta, and cyan) and black toner based on the output signals from the same light sensor 200.

The reference value Vref (color) and the reference value Vref (black) both for end-of-toner determination are set as follows.

Figure 9:
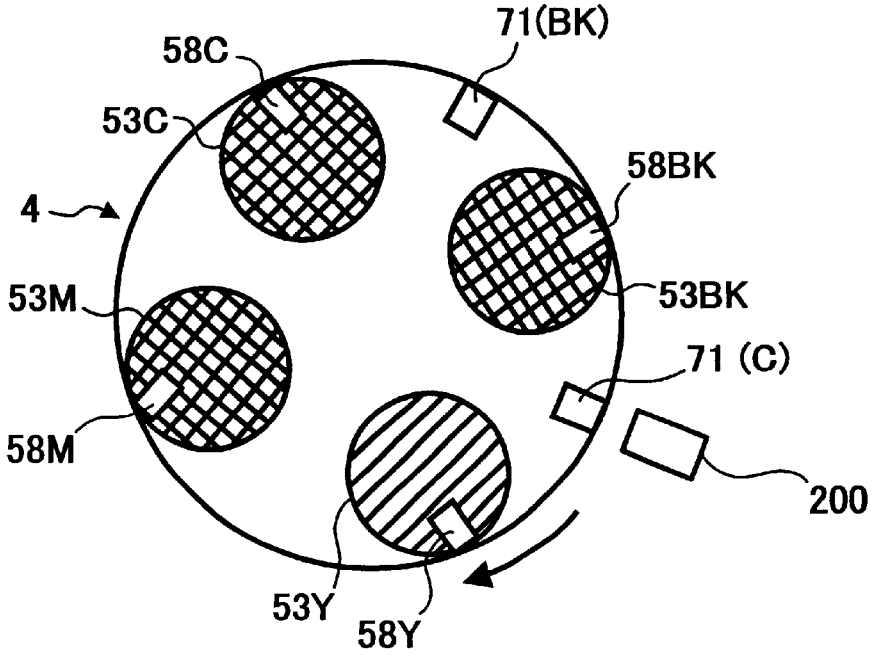
FIG. 9 is an explanatory view illustrating an arrangement of a reference reflector in a revolver-developing unit according to the present invention.
Figure 10:
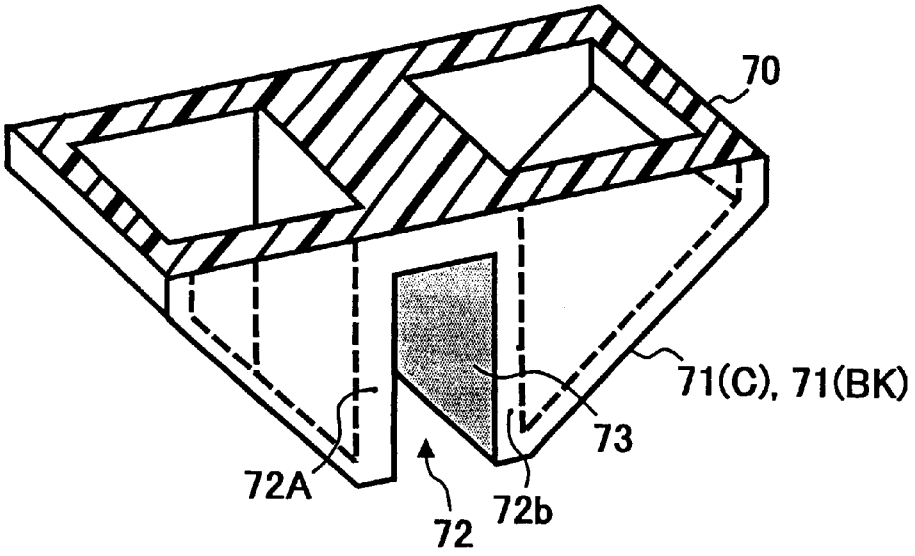
FIG. 10 is a perspective view of the reference reflector of FIG. 9.

As illustrated in FIG. 9, for example, a reference reflector 71 (C) and a reference reflector 71 (BK) both serving as reference light path forming units are provided between the toner cartridges in the revolver-developing unit 4. Specifically, the reference reflector 71(BK) is provided between toner cartridges 53C (cyan) and 53BK (black), and the reference reflector 71(C) is provided between toner cartridges 53BK and 53Y (yellow). Toner cartridge 53M (magenta) is also shown, as are reflectors 58C (cyan), 58BK (black), 58Y (yellow), and 58M (magenta). The reference reflector 71 (C) and the reference reflector 71 (BK) are configured such that each light path is not stained with scattered toner. As illustrated in FIG. 10, the reference reflector 71 (C) and the reference reflector 71 (BK) have similar configurations as the reflector 58, and descriptions of the members having substantially the same functions as the ones used in the reflector 58 are omitted. The reference reflector 71(C) and the reference reflector 71(BK) each have a concave part 72. On the surfaces of side walls 72*a* and 72*b* of the concave part 72, a light-absorbing member 73 is provided such that the light beam emitted from the light-emitting unit 60 of the light sensor 200 passes through the concave part 72 at a predetermined transmission factor for determining an end-of-toner condition. For example, a transmission factor is set to 1% for color toner, and 0.3% for black toner in this embodiment. In addition, like the reflector 58, the light-shielding member 70 made of lightproof material is attached by an adhesive double coated tape (not shown) on each exterior part of the reference reflector 71(C) and the reference reflector 71((BK) as diagonally shaded area in FIG. 10 illustrates.

In order to set a reference value Vref (color) for detection of end-of-toner condition, the reference reflector 71 (C) is moved to the position facing the light sensor 200 by rotating the revolver-developing unit 4. FIG. 9 illustrates the condition when the reference reflector 71(C) stops at the position facing the light sensor 200. In this condition, the light sensor 200 is turned on and a light beam is emitted from the light-emitting unit 60 to the reference reflector 71 (C). Then, the value of output signals from the light sensor 200 is recorded in a memory of the controller 300 and is set as the reference value Vref (color). A reference value Vref (black)

is set in the same manner by moving the reference reflector 71 (BK) to the position facing the light sensor 200.

Further, after the development operation, the revolver-developing unit 4 may stop at the home position such that the reference reflector 71(C) or the reference reflector 71 (BK) is located at the position facing the light sensor 200. Thereby, the reference value Vref (color) or the reference value Vref (black) can be set efficiently without causing the reference reflector 71(C) or the reference reflector 71 (BK) to move to the position facing the light sensor 200.

Although two reference reflectors are provided for setting the reference value Vref (color) and the reference value Vref (black) in this embodiment, the number of reference reflector can be changed according to the colors of toner. For example, four reference reflectors may be provided for each toner color of yellow, magenta, cyan, and black to set each reference value Vref.

In the above-described embodiment, the light sensor 200 outputs signals according to the toner amount in the light path of the reflector 58. As the reference value Vref for the end-of-toner determination can be set according to the color of toner, the end-of-toner condition in the toner cartridge can be accurately determined for each toner.

Further, as the reference value Vref for the end-of-toner determination can be changed corresponding to the condition of the light sensor 200, i.e., sensitivity of the light sensor, a stain by toner, or the like, the end-of-toner condition in the toner cartridge can be precisely determined.

According to this embodiment, because the end-of-toner condition is detected by the light-emitting unit 60 and the light-receiving unit 61 that are provided outside the toner cartridge 53, when compared with the developing apparatus in which the light-emitting unit 60 and the light-receiving unit 61 are provided inside the toner cartridge 53, the developing apparatus offers advantage of ease of replacing the toner cartridge 53.

As one example of an alternative to the burst emission, pulse modulated light may be employed as the light emitted from the light-emitting unit 60 of the light sensor 200. A light sensor using the pulse modulated light includes a light-emitting unit that emits the pulse modulated light, a light-receiving unit that receives the pulse modulated light, and a gate circuit synchronized with output signals from the light sensor and which inhibits the output signals from passing through the gate circuit corresponding to the quiescent time of pulse modulated light. After the light sensor outputs signals upon receiving the pulse modulated light, the gate circuits is turned off during the quiescent time of the pulse modulated light. Therefore, if the light-receiving unit receives disturbance light during the quiescent time of the pulse modulated light, a noise by the disturbance light is not output from the gate circuit. Owing to the above configuration and operation, an end-of-toner detection device using the pulse modulated light can also avoid the error of end-of-toner detection.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A developing apparatus, comprising:

a developing device configured to develop latent images formed on an image bearing member so as to form toner images;

a toner storage unit configured to store toner to supply to the developing device;

a light path forming unit that protrudes from a wall of the toner storage unit into an interior of the toner storage unit and configured to form a light path through which light passes in the toner storage unit;

a light sensor including a light-emitting unit which emits light and a light-receiving unit which receives light emitted from the light-emitting unit, wherein the light sensor outputs signals smoothly changing according to an amount of toner in the light path formed in the light path forming unit.

2. The developing apparatus according to claim 1, farther comprising a developing unit which includes plural sets of the developing device, the toner storage unit, and the light path forming unit, and a developing unit driving device which drives the developing unit such that each developing device moves to a developing position facing the image bearing member together with each toner storage unit corresponding to the developing device, wherein each light path forming unit moves to a position facing the light sensor by driving the developing unit.

3. The developing apparatus according to claim 2, further comprising a reference light path forming unit provided at a position between each developing device and the light sensor, in which light emitted from the light sensor passes through a light path in the reference light path forming unit at a predetermined transmission factor for determining an end-of-toner condition, wherein plural reference light path forming units are provided according to a color of toner deposited in the toner storage unit.

4. The developing apparatus according to claim 3, wherein each reference light path forming unit is configured to face the light sensor by driving the developing unit.

5. The developing apparatus according to claim 1, further comprising a light-shielding member attached on an exterior part of the light path forming unit which faces the light-emitting unit and the light-receiving unit of the light sensor.

6. A developing apparatus comprising:

a developing device configured to develop latent images formed on an image bearing member so as to form toner images;

a toner storage unit configured to store toner to supply to the developing device;

a light path forming unit that protrudes from a wall of the toner storage unit into an interior of the toner storage unit and configured to form a light path through which light passes in the toner storage unit;

a light sensor including a light-emitting unit which emits light and a light-receiving unit which receives light emitted from the light-emitting unit, wherein the light sensor outputs signals smoothly changing according to an amount of toner in the light path formed in the light path forming unit; and a reference light path forming unit provided at a position between the developing device and the light sensor, in which light emitted from the light sensor passes through a light path in the reference light path forming unit at a predetermined transmission factor for determining an end-of-toner condition.

7. The developing apparatus according to claim 6, further comprising a light-shielding member attached on an exterior part of the reference light path forming unit which faces the light-emitting unit and the light-receiving unit of the light sensor.

8. An image forming apparatus, comprising:

an image bearing member;

a latent image forming device configured to form latent images on the image bearing member;

a developing apparatus including:

a developing device configured to develop latent images formed on the image bearing member so as to form toner images;

a toner storage unit configured to store toner to supply to the developing device;

a light path forming unit that protrudes from a wall of the toner storage unit into an interior of the toner storage unit and configured to form a light path through which light passes in the toner storage unit; and a light sensor including a light-emitting unit which emits light and a light-receiving unit which receives light emitted from the light-emitting unit, wherein the light sensor outputs signals smoothly changing according to an amount of toner in the light path formed in the light path forming unit;

a transfer device configured to transfer the latent images on the image bearing member to a transfer material; and an end-of-toner determination device configured to determine an end-of-toner condition in the toner storage unit based on output signals from the light sensor.

9. The image forming apparatus according to claim 8, wherein the developing apparatus further includes a developing unit which includes plural sets of the developing device, the toner storage unit, and the light path forming unit, and a developing unit driving device which drives the developing unit such that each developing device moves to a developing position facing the image bearing member together with each toner storage unit corresponding to the developing device, wherein each light path forming unit moves to a position facing the light sensor by driving the developing unit.

10. The image forming apparatus according to claim 9, wherein the developing apparatus further including a reference light path forming unit provided at a position between each developing device and the light sensor, in which light emitted from the light sensor passes through a light path in the reference light path forming unit at a predetermined transmission factor for determining an end-of-toner condition, wherein plural reference light path forming units are provided according to a color of toner deposited in the toner storage unit.

11. The image forming apparatus according to claim 10, wherein each reference light path forming unit is configured to face the light sensor by driving the developing unit.

12. The image forming apparatus according to claim 8, further comprising a light-shielding member attached on an exterior part of the light path forming unit which faces the light-emitting unit and the light-receiving unit of the light sensor.

13. An image forming apparatus comprising:

an image bearing member;

a latent image forming device configured to form latent images on the image bearing member;

a developing apparatus including:

a developing device configured to develop latent images formed on the image bearing member so as to form toner images;

a toner storage unit configured to store toner to supply to the developing device; and a light path forming unit that protrudes from a wall of the toner storage unit into an interior of the toner storage unit and configured to form a light path through which light passes in the toner storage unit;

a light sensor including a light-emitting unit which emits light and a light-receiving unit which receives light emitted from the light-emitting unit, wherein the light sensor outputs signals smoothly changing according to an amount of toner in the light path formed in the light path forming unit;

a transfer device configured to transfer the latent images on the image bearing member to a transfer material;

an end-of-toner determination device configured to determine an end-of-toner condition in the toner storage unit based on output signals from the light sensor;

wherein the developing apparatus further includes a reference light path forming unit provided at a position between the developing device and the light sensor, in which light emitted from the light sensor passes through a light path in the reference light path forming unit at a predetermined transmission factor for determining an end-of-toner condition.

14. The image forming apparatus according to claim 13, further comprising a light-shielding member attached on an exterior part of the reference light path forming unit which faces the light-emitting unit and the light-receiving unit of the light sensor.

15. An image forming apparatus comprising:

an image bearing member;

a latent image forming device configured to form latent images on the image bearing member;

a developing apparatus including:

a developing device configured to develop latent images formed on the image bearing member so as to form toner images;

a toner storage unit configured to store toner to supply to the developing device; and a light path forming unit that protrudes from a wall of the toner storage unit into an interior of the toner storage unit and configured to form a light path through which light passes in the toner storage unit;

a light sensor including a light-emitting unit which emits light and a light-receiving unit which receives light emitted from the light-emitting unit, wherein the light sensor outputs signals smoothly changing according to an amount of toner in the light path formed in the light path forming unit;

a transfer device configured to transfer the latent images on the image bearing member to a transfer material;

an end-of-toner determination device configured to determine an end-of-toner condition in the toner storage unit based on output signals from the light sensor;

wherein the developing apparatus further includes plural sets of the developing device, the toner storage unit, and the light path forming unit, and a developing unit driving device which drives each developing device such that each developing device moves to a developing position facing the image bearing member together with each toner storage unit corresponding to the developing device, and wherein the end-of-toner determination device determines an end-of-toner condition in each toner storage unit based on a comparison between a value of output signals from the light sensor and a reference value for determining an end-of-toner condition, and wherein the reference value for the end-of-toner determination is set according to a color of toner deposited in the toner storage unit.

16. A developing apparatus comprising:

developing means for developing latent images formed on an image bearing member so as to form toner images;

toner storage means for storing toner to supply to the developing means;

light path means for forming a light path through which light passes in the toner storage unit; and light sensor means for emitting light in the light path and for recovering the emitted light, wherein the light sensor means outputs signals smoothly changing according to an amount of toner in the light path.

17. The developing apparatus according to claim 16, further comprising developing unit means which includes plural sets of the developing means, the toner storage means, and the light path means, and a developing unit means driving means for driving the developing unit means such that each developing means moves to a developing position facing the image bearing member together with each toner storage means corresponding to the developing means, wherein each light path means moves to a position facing the light sensor means by driving the developing unit means.

18. The developing apparatus according to claim 17, further comprising reference light path means provided at a position between each developing means and the light sensor means, in which light emitted from the light sensor means passes through a light path in the reference light path means at a predetermined transmission factor for determining an end-of-toner condition, wherein plural reference light path means are provided according to a color of toner deposited in the toner storage means.

19. The developing apparatus according to claim 18, wherein each reference light path means faces the light sensor means by driving the developing unit means.

20. A developing apparatus comprising:

developing means for developing latent images formed on an image bearing member so as to form toner images;

toner storage means for storing toner to supply to the developing means;

light path means for forming a light path through which light passes in the toner storage unit;

light sensor means for emitting light and for recovering the emitted light; and reference light path means provided at a position between the developing means and the light sensor means, in which light emitted from the light sensor means passes through a light path in the reference light path means at a predetermined transmission factor for determining an end-of-toner condition.

21. The developing apparatus according to claim 20, further comprising light-shielding means facing the light sensor means.

22. An image forming apparatus, comprising:

image bearing means;

latent image forming means for forming latent images on the image bearing means;

a developing apparatus including:

developing means developing latent images formed on the image bearing means so as to form toner images;

toner storage means for storing toner to supply to the developing means;

light path means for forming a light path through which light passes in the toner storage means; and light sensor means for emitting light in the light path and for receiving the emitted light, wherein the light sensor means outputs signals smoothly changing according to an amount of toner in the light path;

transfer means for transferring the latent images on the image bearing means to a transfer material; and end-of-toner determination means for determining an end-of-toner condition in the toner storage means based on output signals from the light sensor means.

23. The image forming apparatus according to claim 22, wherein the developing apparatus further includes developing unit means which includes plural sets of the developing means, the toner storage means, and the light path means, and a developing unit means driving means for driving the developing unit means such that each developing means moves to a developing position facing the image bearing means together with each toner storage means corresponding to the developing means, wherein each light path means moves to a position facing the light sensor means by driving the developing unit means.

24. The image forming apparatus according to claim 23, wherein the developing means further includes reference light path means provided at a position between each developing means and the light sensor means, in which light emitted from the light sensor means passes through a light path in the reference light path means at a predetermined transmission factor for determining an end-of-toner condition, wherein plural reference light path means are provided according to a color of toner deposited in the toner storage means.

25. The image forming apparatus according to claim 24, wherein each reference light path means faces the light sensor means by driving the developing unit means.

26. The image forming apparatus according to claim 22, further comprising light-shielding means facing the light sensor means.

27. An image forming apparatus comprising:

image bearing means;

latent image forming means for forming latent images on the image bearing means;

a developing apparatus including:

developing means developing latent images formed on the image bearing means so as to form toner images;

toner storage means for storing toner to supply to the developing means;

light path means for forming a light path through which light passes in the toner storage means; and light sensor means for emitting light and for receiving the emitted light;

transfer means for transferring the latent images on the image bearing means to a transfer material; and end-of-toner determination means for determining an end-of-toner condition in the toner storage means based on output signals from the light sensor means, wherein the developing means further includes reference light path means provided at a position between the developing means and the light sensor means, in which light emitted from the light sensor means passes through a light path in the reference light path means at a predetermined transmission factor for determining an end-of-toner condition.

28. The image forming apparatus according to claim 27, further comprising light-shielding means facing the light sensor means.

29. An image forming apparatus comprising:

image bearing means;

latent image forming means for forming latent images on the image bearing means;

a developing apparatus including:

developing means developing latent images formed on the image bearing means so as to form toner images;

toner storage means for storing toner to supply to the developing means;

light path means for forming a light path through which light passes in the toner storage means; and light sensor means for emitting light and for receiving the emitted light;

transfer means for transferring the latent images on the image bearing means to a transfer material; and end-of-toner determination means for determining an end-of-toner condition in the toner storage means based on output signals from the light sensor means, wherein the developing means further includes reference plural sets of the developing means, the toner storage means, and the light path means, and a developing unit means driving means for driving the developing apparatus such that each developing means moves to a developing position facing the image bearing means together with each toner storage means corresponding to the developing means, and wherein the end-of-toner determination means determines an end-of-toner condition in each toner storage means based on a comparison between a value of output signals from the light sensor means and a reference value for determining an end-of-toner condition, and wherein the reference value for the end-of-toner determination is set according to a color or toner deposited in the toner storage means.

* * * * *